US005373602A

United States Patent [19]

Bang

[11] Patent Number: 5,373,602

[45] Date of Patent: Dec. 20, 1994

[54] TOOTHBRUSH

[76] Inventor: Kook B. Bang, 115 Bryn Mawr Ave., Newton Square, Pa. 19073

[21] Appl. No.: 166,884

[22] Filed: Dec. 15, 1993

[51] Int. Cl.[5] ..... A46B 9/04

[52] U.S. Cl. ..... 15/167.1; 15/106; 15/110; 15/201

[58] Field of Search ..... 15/106, 110, 167.1, 15/172, 201

[56] References Cited

U.S. PATENT DOCUMENTS

| | | | |
|---|---|---|---|
| 888,138 | 5/1908 | Bell | 15/110 |
| 1,369,664 | 2/1921 | Izawa | 15/172 |
| 1,532,522 | 4/1925 | Weaver, Jr. | 15/172 |
| 1,592,207 | 7/1926 | Havrilla | 15/167.1 |
| 1,993,662 | 3/1935 | Green | 15/167.1 |
| 2,266,195 | 12/1941 | Hallock | 15/167.1 |
| 2,676,350 | 4/1954 | Bressler | 15/201 |
| 3,146,478 | 9/1964 | Rosenthal | 15/110 |
| 3,253,292 | 5/1966 | Herschensohn | 15/201 |
| 3,258,805 | 7/1966 | Rossnan | 15/167.1 |
| 4,128,910 | 12/1978 | Nakata | 15/188 |
| 4,654,922 | 4/1987 | Chen | 15/172 |

FOREIGN PATENT DOCUMENTS

| | | | |
|---|---|---|---|
| 0360766 | 3/1990 | European Pat. Off. | 15/167.1 |
| 707727 | 7/1931 | France | 15/201 |
| 2548528 | 1/1985 | France | 15/167.1 |
| 2550068 | 2/1985 | France | 15/167.1 |
| 2652245 | 3/1991 | France | 15/167.1 |
| 283131 | 4/1915 | Germany | 15/172 |
| 3628722 | 2/1988 | Germany | 15/167.1 |

*Primary Examiner*—David A. Scherbel
*Assistant Examiner*—Randall E. Chin
*Attorney, Agent, or Firm*—Birch, Stewart, Kolasch & Birch

[57] ABSTRACT

The present invention relates to a toothbrush including a flexible extension which is attached to the outside of a brush head for perfectly cleaning the back teeth and minimizing scratches on the periodontal tissue surface and oral cavity.

4 Claims, 1 Drawing Sheet

TOOTHBRUSH

BACKGROUND OF THE INVENTION

1. Field of the Invention

The present invention relates to an improved toothbrush which is effective in cleaning the back teeth and for brushing the teeth with the least amount of scratching on the periodontal tissue surface of the oral cavity.

2. Description of Related Art

Generally speaking, toothbrushes are manufactured by implanting the bristle bases in a stick-shape or hexahedral upper portion as is known in the art. Currently, several types of toothbrushes disclose in relation to efficiency in brushing the teeth by making the ends of these bristle bases constant or by transforming the handle and the bristle base implanting portion. However, these toothbrushes cannot effectively minimize scratches on the periodontal tissue surface and oral cavity. Also, these toothbrushes cannot perfectly clean the inner surface of the teeth such as back teeth.

SUMMARY OF THE INVENTION

Accordingly, it is an object of the present invention to provide a toothbrush, which eliminates the above problems encountered with a conventional toothbrush.

Another object of the present invention is to provide a toothbrush having a flexible extension containing a plurality of bristles and a flexible element which covers the back of the head for minimizing scratches on the periodontal tissue surface of the oral cavity.

Other objects and further scope of applicability of the present invention will become apparent from the detailed description given hereinafter. It should be understood, however, that the detail description and specific examples, while indicating preferred embodiments of the invention, are given by way of illustration only, since various changes and modifications within the spirit and scope of the invention will become apparent to those skilled in the art from this detailed description.

Briefly described, the present invention relates to a toothbrush having a flexible extension containing a plurality of bristles and a flexible element which covers the back of the head for minimizing scratches on the periodontal tissue surface of the oral cavity. The flexible material can be a natural or synthetic rubber material.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
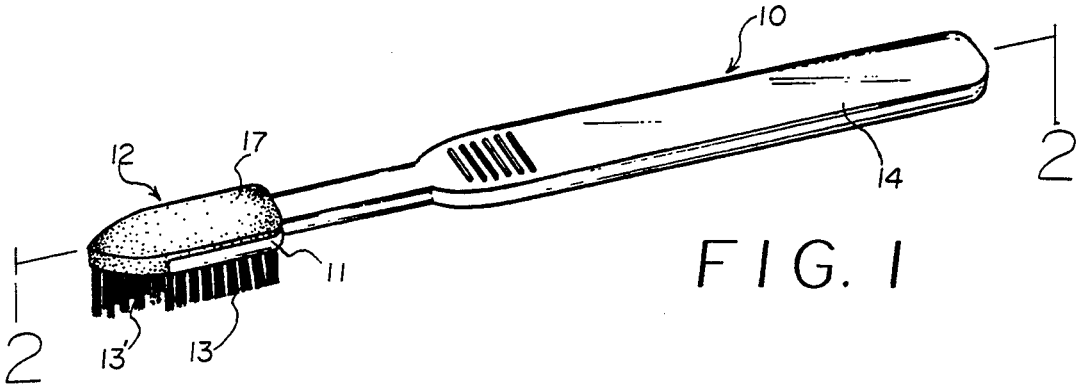
FIG. 1 is a perspective view of the toothbrush according to the present invention.
Figure 2:
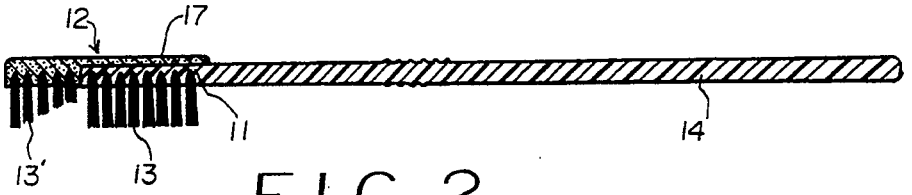
FIG. 2 is an enlarged, broken perspective view of the toothbrush according to the present invention.
Figure 3:
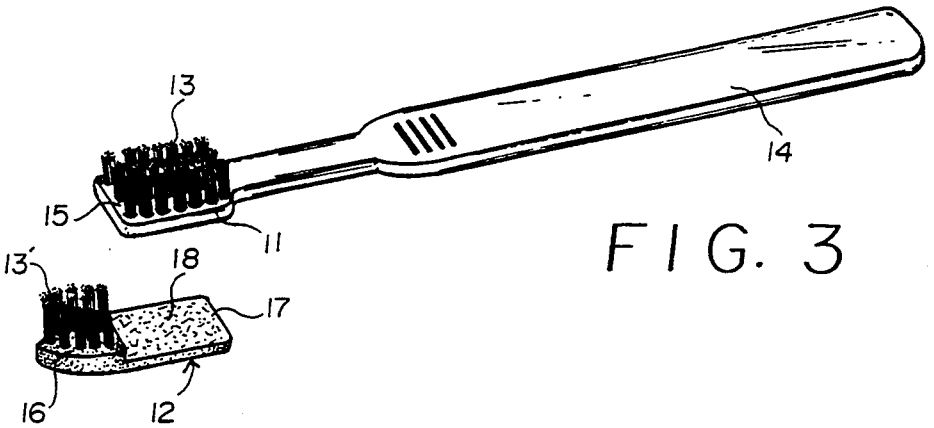
FIG. 3 is a sectional view of FIG. 1, taken along line 3—3.

Referring now in detail to the drawings for the purpose of illustrating the preferred embodiments of the present invention, the toothbrush 10 as shown in FIGS. 1, 2, and 3, comprises a brush head 11 including a flexible extension member 12 disposed on the brush head 11, a plurality of bristles extending from the inner planar surface 15 of the brush head 11, and a handle 14 extending to connect with the brush head.

Figure 4:
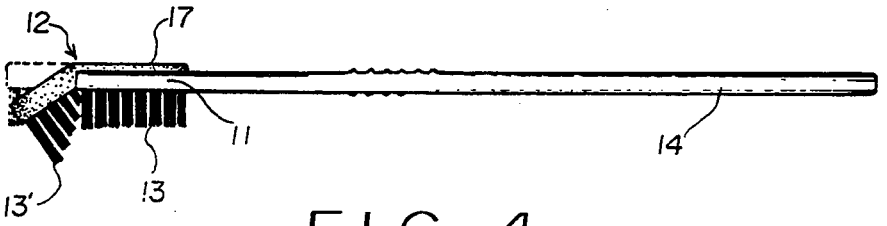
FIG. 4 is a sectional view of the toothbrush according to the present invention showing the bending state of the end portion thereof.

As shown in FIGS. 2 and 4, the flexible extension member 12 includes a cover 17 which is attached to the outer planar surface of the brush head 11 by an adhesive 18. The member 12 also has an inner stepped surface. Bristles 13' are attached to the surface 16 which extends in a longitudinal direction away from the handle beyond the outer planar surface of the brush head of the flexible extension portion and bristles 13 are attached to the brush head surface 15. The bristles 13' contain a plurality of shorter bristles near the transition point between the flexible and fixed portions of the toothbrush head so that the flexible extended portion of the toothbrush head can flex while avoiding conflict with the bristles 13 of the main head portion of the brush.

The flexible extension member 12 is made of rubber, so that the surface thereof can minimize scratching while massaging the periodontal tissue surface. Accordingly, the flexible extension member 12 can be used to effectively clean the back teeth.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A toothbrush comprising:

an elongated handle;

a brush head integrally and rigidly fixed to said handle and in longitudinal alignment therewith, said brush head having inner and outer planar surfaces;

a plurality of brush head bristles of a uniform length fixed to the inner planar surface of said brush head;

a flexible extension member fixed to the outer planar surface of said brush head, at least a portion of said flexible extension member extending in a longitudinal direction away from the handle beyond the outer planar surface of said brush head, said flexible extension member having an inner surface and an outer planar surface;

a plurality of flexible extension member bristles of a uniformly varying length fixed to the portion of said flexible extension member which extends beyond the outer planar surface of said brush head, with shortest ones of said plurality of extension member bristles positioned adjacent said brush head bristles, wherein said flexible extension member is bendable during use such that said extension member bristles converge towards said brush head bristles.

2. The toothbrush of claim 1, wherein a first portion of the inner surface of said flexible extension member overlays the outer planar surface of said brush head and a second portion of the inner surface of said flexible extension member receives said extension member bristles.

3. The toothbrush of claim 2, wherein the first portion of the inner surface includes an adhesive thereon for adhering said flexible extension member to the outer planar surface of said brush head.

4. The toothbrush of claim 1, wherein said flexible extension member is formed of rubber.

* * * * *